US006009625A

United States Patent [19]

Keathley

[11] Patent Number: 6,009,625

[45] Date of Patent: Jan. 4, 2000

[54] HOLE FORMING ASSEMBLY FOR IRRIGATION TUBING

[75] Inventor: Bob N. Keathley, Bernie, Mo.

[73] Assignee: IXL Manufacturing Company, Inc., Bernie, Mo.

[21] Appl. No.: 09/080,467

[22] Filed: May 19, 1998

[51] Int. Cl.[7] ..... B26F 1/46

[52] U.S. Cl. ..... 30/358; 30/301; 30/316

[58] Field of Search ..... 30/299, 301, 314, 30/315, 316, 358; 83/698.71, 698.91

[56] References Cited

U.S. PATENT DOCUMENTS

| | | | |
|---|---|---|---|
| 580,916 | 4/1897 | Westerfield . | |
| 893,043 | 7/1908 | Westerberg . | |
| 1,483,661 | 2/1924 | Hall . | |
| 1,789,729 | 1/1931 | Coyle . | |
| 2,019,009 | 10/1935 | Hendrix . | |
| 2,086,435 | 7/1937 | Rapp | 30/301 |
| 2,145,725 | 1/1939 | Jamieson . | |
| 3,171,200 | 3/1965 | Poppenga | 30/301 |
| 3,203,295 | 8/1965 | Sauer . | |
| 3,726,545 | 4/1973 | Grim et al. . | |
| 4,010,543 | 3/1977 | Nushaum . | |
| 4,277,891 | 7/1981 | Dick . | |
| 5,461,788 | 10/1995 | Taylor | 30/316 |
| 5,579,582 | 12/1996 | Carlson | 30/316 |
| 5,720,991 | 2/1998 | Gildersleeve et al. | 30/316 |

*Primary Examiner*—Hwei-Siu Payer
*Attorney, Agent, or Firm*—Neil F. Markva

[57] ABSTRACT

A hand tool combination is useful for punching various sized holes in the sidewall of irrigation tubing to discharge water onto crop-growing soil. The tool combination comprises an elongated handle member including a hand grasping section at one end thereof and carrying a cutter element assembly at the other end thereof. The cutter element assembly includes at least one hole-forming cutting element removably mounted to a cutting element carrier module. A plurality of cutting elements each includes a cutting edge effective to penetrate the sidewall of the irrigation tubing when thrust against the tubing by an individual gripping the hand grasping section and swinging the cutter element assembly toward the sidewall.

20 Claims, 4 Drawing Sheets

HOLE FORMING ASSEMBLY FOR IRRIGATION TUBING

FIELD OF THE INVENTION

This invention relates to irrigation systems for having penetratable tubular water delivery system for gardens and agricultural field crops. More particularly, the invention is directed to forming water discharge openings in thin-walled water-carrying tubes of a field irrigation system.

BACKGROUND OF THE INVENTION

The use of plastic irrigation pipe or tubing to carry water to crops planted in fields is well known. Water is pumped from a pumping station into thin-walled pipe or flexible tubing. Earlier irrigation systems used rows of aluminum pipe having ports with gates. The gates were opened to release the water, which flowed down the rows, to thereby discharge water along its length into the soil. Placing several miles of these pipes was very labor intensive each Spring of the year because the aluminum sections were usually 30 to 40 feet long. Gradually, this prior system was replaced with thin-walled pipe or plastic tubing that is flexible enough to be rolled out from a large roll carried by a tractor. The outer end of the unrolled tubing is tied or closed off, and the other end is coupled to the pumping station for pumping water into the plastic tubing.

The known plastic tubing is very strong and holds a significant amount of water pressure. Once the thin, flexible tubing is filled with water, a known tool carrying at least one punch device on the end of an elongated handle is struck against the outer outside surface of the filled plastic tubing to penetrate the tubing and to thus form a hole therein. This is done by an individual carrying the tool having an elongated handle and swinging the cutting edge of the cutting tool mounted at the outer end of the elongated handle against the thin-walled pipe that is expanded outwardly under the pressure of the water contained therein. The pressure of the water is greater at distances that are closer to the pump where the holes formed in the tubing must be smaller. And as the holes are formed further away from the pump, they must be larger to get the desired substantially uniform discharge of water because less pressure exists in the tubing further from the pump. The current tool used to form such holes is heavy because it is made of metal with cutting elements welded to the four outer sidewalls of a cubically formed main body. The cutting elements are therefore integrally formed to the outside surface of the metal walls forming the cubical base. In addition to being too heavy, the cutting elements become dented during use and transporting from storage to the fields in which the irrigation tubing is being punctured.

Various types of cutting tools are known for cutting holes through sheet metal, metal containers, and the like. U.S. Pat. Nos. 893,043; 1,483,661; and 2,019,009 disclose various types of mechanical devices used to form openings through a package or container sidewall. The following patents show various types of circular cutting devices used to cut, saw, or punch circular openings in sheet material.

| | | | |
|---|---|---|---|
| 580,916 | 2,086,435 | 3,203,295 | 4,010,543 |
| 1,789,729 | 2,145,725 | 3,726,545 | 4,277,891 |

None of these prior art devices are capable of forming the openings desired in the irrigation tubing in the manner described above.

PURPOSE OF THE INVENTION

The primary object of the invention is to provide an improved hole punching device useful in forming various sized openings in water-carrying irrigation tubing.

Another object of the invention is to provide a tube wall cutting assembly including a cutting element carrier module having a plurality of cutting elements that may be interchangeably used in the carrier module.

Another object of the invention is to provide a low-cost cutting hand tool for producing holes in irrigation tubing and having an elongated handle to be grasped at one end and carrying a cutter assembly at the other end thereof.

A still further object of the invention is to provide a plurality of cutting elements, which may be nested together and wherein different sized openings may be made in the sidewall of a thin-walled plastic irrigation tubing by interchanging cutting elements.

SUMMARY OF THE INVENTION

The invention is directed to a hand tool assembly having an elongated handle with means mounting a cutting assembly at an outer end thereof. The cutting assembly includes a cutting element carrier module with interchangeable cutting elements. The carrier portion includes at least one sidewall section having a structural configuration effective to slidingly receive a supporting base to which a rigid tubular cutting element is fixedly secured. A feature of this invention provides each cutting element as a one-piece molded configuration. The tubular cutting element has a cutting edge along the free outer end thereof and opens to the inside of the carrier module so that the resultant separated material removed from the tubing upon penetrating the sidewall of the tubing is discharged into the inner portion of the carrier module.

A specific embodiment of the invention has at least one interchangeable carrier element and at least one pair of support base receiving slots into which an interchangeable cutting element may slidingly fit. In a specific embodiment of the invention, the carrier module includes a rectangular cube-shaped carrier module having cutting element receiving slots on opposed sides thereof. The device of the invention is used to form holes in the irrigation tubing while the individual user walks along the tubing away from the pump station. The further the distance from the pump, larger holes are required to achieve a substantially uniform discharge of water along the tubing length. A smaller cutting element is disposed initially in the carrier section closer to the pump station. And with the invention, the small hole-forming element may be easily removed and replaced with another element that forms holes larger in diameter. The outer walls of the cutting element that project outwardly from the base support portion are slightly tapered so that the cutting elements may be slidingly fit and nested together as desired for convenient storage and transport.

A particular feature of the invention provides a set of ten different cutting elements, which cut sidewall openings from one inch down to 7/16 of an inch in diameter. Each cutting element in the series of elements differ by 1/16 of an inch in diameter thereby providing cutting elements that produce 7/16, 1/2, 9/16, 5/8, 11/16, 3/4, 13/16, 7/8, 15/16, and 1 inch diameter holes.

The hand tool combination of the invention is used for punching various sized holes in the sidewall of irrigation tubing to discharge water onto crop-growing soil. The combination comprises an elongated handle member including a hand grasping section at one end thereof and carries a cutter element assembly at the other end thereof. The cutter element assembly includes at least one hole forming cutting element removably mounted to a cutting element carrier module and a selection or plurality of cutting elements each having cutting edge means that is effective to penetrate the sidewall of the irrigation tubing when thrust against the tubing by an individual gripping the hand grasping section and swinging the cutter element assembly into the sidewall.

A feature of the invention is directed to the cutting element, which includes a base portion and cutting edge support means projecting outwardly from one side of the base portion to provide the cutting means at a laterally spaced distance from the base portion to effect the penetration of the irrigation tubing sidewall. The cutting element carrier module includes means for removably receiving the base portion of the cutting element to direct the cutting edge support means outwardly from the cutter element assembly. Each cutting element includes base means having shoulder means disposed on opposing sides thereof. The carrier module includes slot means to slidingly receive the shoulder means and secure the base means in a fixed operating position within the carrier module. In a specific embodiment, each of the cutting elements include abutment means for tightening the disposition of each cutting element within the slot means.

Another feature of the invention is directed to the plurality of cutting elements wherein each element has cutting edge means that produces different sized openings upon penetration of the sidewall. That is, each different cutting element forms a different sized opening. Each cutting element includes a base portion and cutting edge support means projecting outwardly from one side of the base portion and each cutting edge support means comprises an annular wall portion having an outer end section that includes the cutting edge means. In one embodiment, the outer end section of each annular wall portion has a scalloped outer edge that forms the cutting edge means. In another embodiment, the outer edge section of each annular wall portion has a straight outer edge that forms the cutting edge means.

In a specific embodiment, the annular wall portion is cylindrical, and the cutting edge means produces circular openings in the irrigation tubing sidewall. Each cutting edge means for the different cutting elements forms an opening in the sidewall that differs by at least 1/16 of an inch in diameter. Each annular wall portion includes tapered inner and outer surfaces effective to enable the nesting together of the plurality of cutting elements. In a specific embodiment, there are ten cutting elements each having a different diameter cylindrical wall portion with cutting edge means that produces a circular opening in the irrigation tubing sidewall. The smallest of the ten cutting elements is effective to form a 7/16 inch diameter circular opening, and the largest is effective to form a 1 inch diameter circular opening.

The cutter element assembly is to be used with an elongated tool handle and comprises means for mounting the assembly to one end of an elongated handle member and at least one hole-forming cutting element removably mounted to a cutting element carrier module. A plurality of interchangeable cutting elements each includes cutting edge means effective to penetrate the sidewall of the irrigation tubing when the cutter element assembly is secured to the elongated handle member and is thrust against the tubing by an individual gripping the hand grasping section. Cutting element carrier module includes means for removably receiving the base portion of the cutting element to direct the cutting edge support means outwardly from the cutter element assembly. Each of the embodiments of the cutter element assembly invention is discussed above as part of the hand tool combination.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
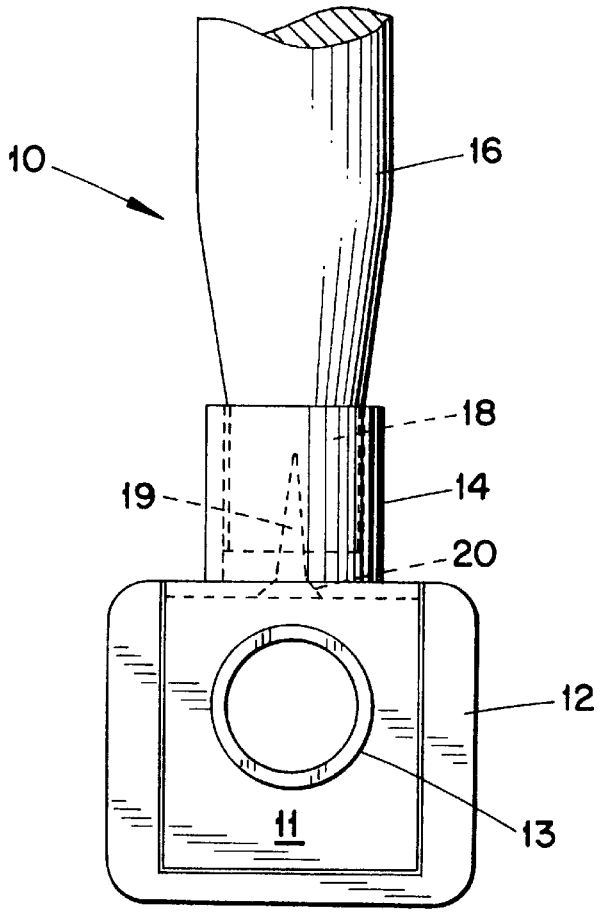
FIG. 1 is a fragmentary side elevational view of a hand tool assembly made in accordance with the invention.

The hand tool combination, generally designated 10, includes an elongated handle member 16 carrying at one end thereof a cutting element carrier module 12 having a handle coupling section 14 projecting upwardly therefrom as shown. Handle member 16 has an outer cylindrical end section 18 that fits into and is received by handle coupling section 14. Threaded screw 19 extends through screw opening 20 and screws into the end of handle member 16 as shown.

Figure 5:
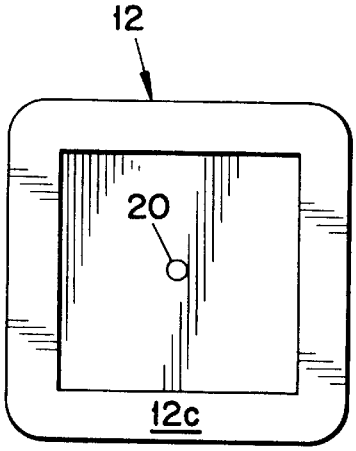
FIG. 5 is a bottom plan view of the carrier module of FIG. 3.
Figure 10:
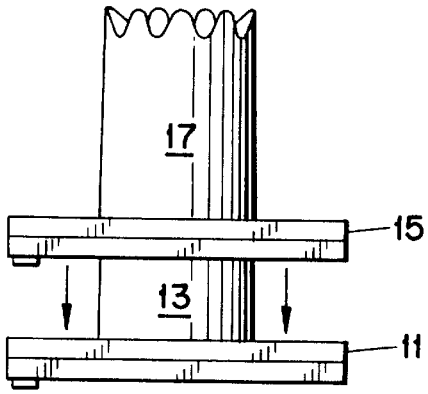
FIG. 10 is a side elevational view showing the nesting capability of the cutting elements of the invention.
Figure 6:
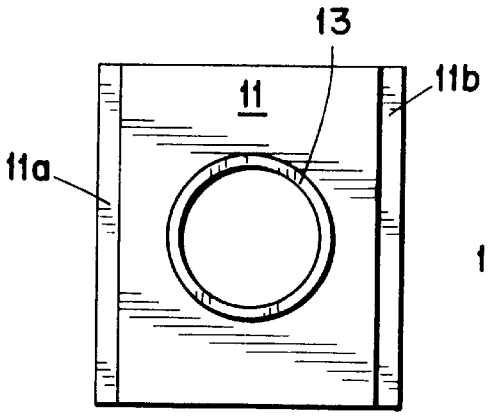
FIG. 6 is a front elevational view of a cutting element made in accordance with the invention.
Figure 7:
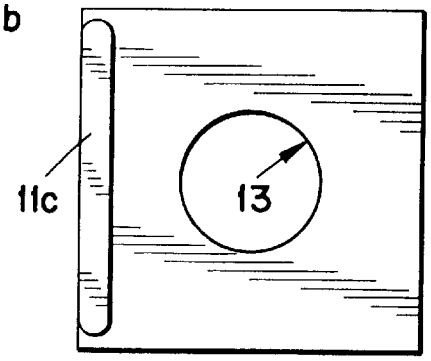
FIG. 7 is a rear elevational view of the cutting element of FIG. 6.
Figure 8:
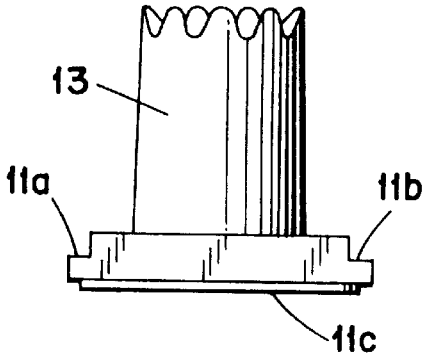
FIG. 8 is a top plan view of the cutting element as shown in FIG. 6.
Figure 9:
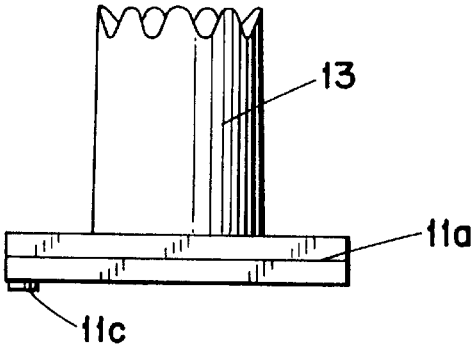
FIG. 9 is a side elevational view of the element of FIG. 8.

Screw opening 20 is tapered to enable the head of wood screw 19 to be countersunk to enable the top of the screw head to be flush with the top surface of the wall portion through which it projects into the end of wood tool handle member 16. FIG. 5 shows the bottom view of carrier module 12 having an outer edge section 12*c* leaving an opening that allows for screw 19 to project through opening 20 and be tightened into the outer end of handle member 16. Screw 19 and coupling section 14 constitute means for mounting the cutter element assembly to handle member 16.

Figure 2:
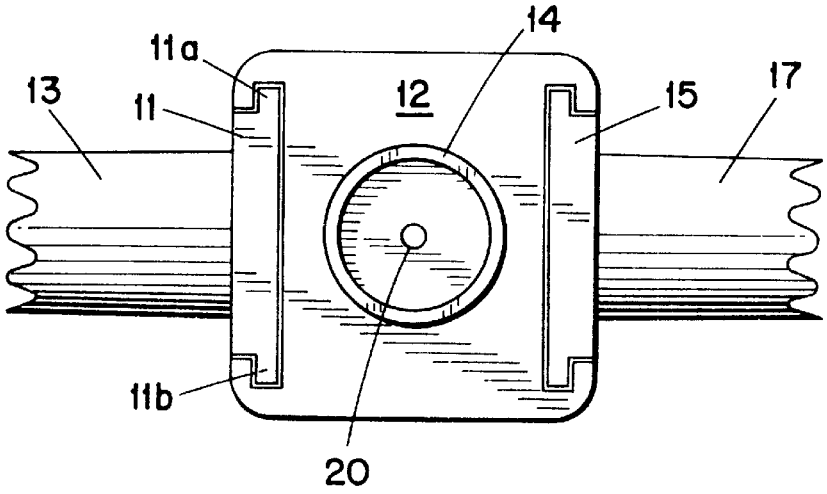
FIG. 2 is a top plan view of the assembly of FIG. 1 shown without the elongated tool handle.
Figure 3:
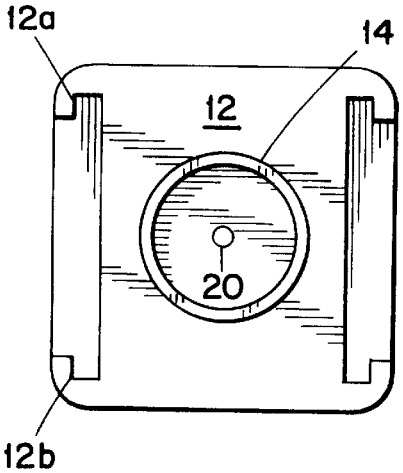
FIG. 3 is a top plan view of the cutting element carrier module shown without cutting elements disposed therein.
Figure 4:
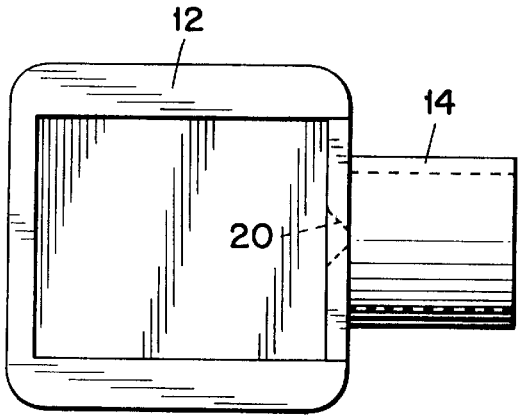
FIG. 4 is a side elevational view of the carrier module of FIG. 3.

Carrier module 12 includes slot means having a matching pair of slotted openings disposed on opposing sides thereof to slidingly receive base support portions 11 and 15 that carry respective tapered cylindrical cutters 13 and 17 as shown. Cutting base portion 11 shown in FIGS. 6–9 includes reduced side shoulders 11*a* and 11*b*, which slidingly contact and mate with shoulders 12*a* and 12*b* of carrier module 12 as shown. Each of the plurality of cutting elements in FIG. 2 have identically shaped configurations to fit the correspondingly substantially identical slot configurations 12*a* and 12*b* on opposing sides of carrier module 12.

Cutting element 11 includes a delimited outwardly projecting abutment section 11*c*, which snaps cutting element 11 in place within the slot configuration of carrier module 12 when in place so that cutting element 11 snugly fits into the slot configuration 12*a* and 12*b*. Carrier module 12 is composed of high impact nylon or other similar material that has resiliency for holding the interchangeable cutting elements in place.

In operation, a plurality of cutting elements may be carried by the worker while walking along the length of irrigation tubing being punctured with the hand tool assembly of the invention. The outer end of handle member 16 is grasped and the cutting element is swung effectively against the outside surface of the irrigation tubing sidewall ballooned outwardly by the pressurized water within the irrigation tubing. The cutting elements may be conveniently exchanged whenever a different sized hole is to be punctured in the tubing sidewall.

Figure 11:
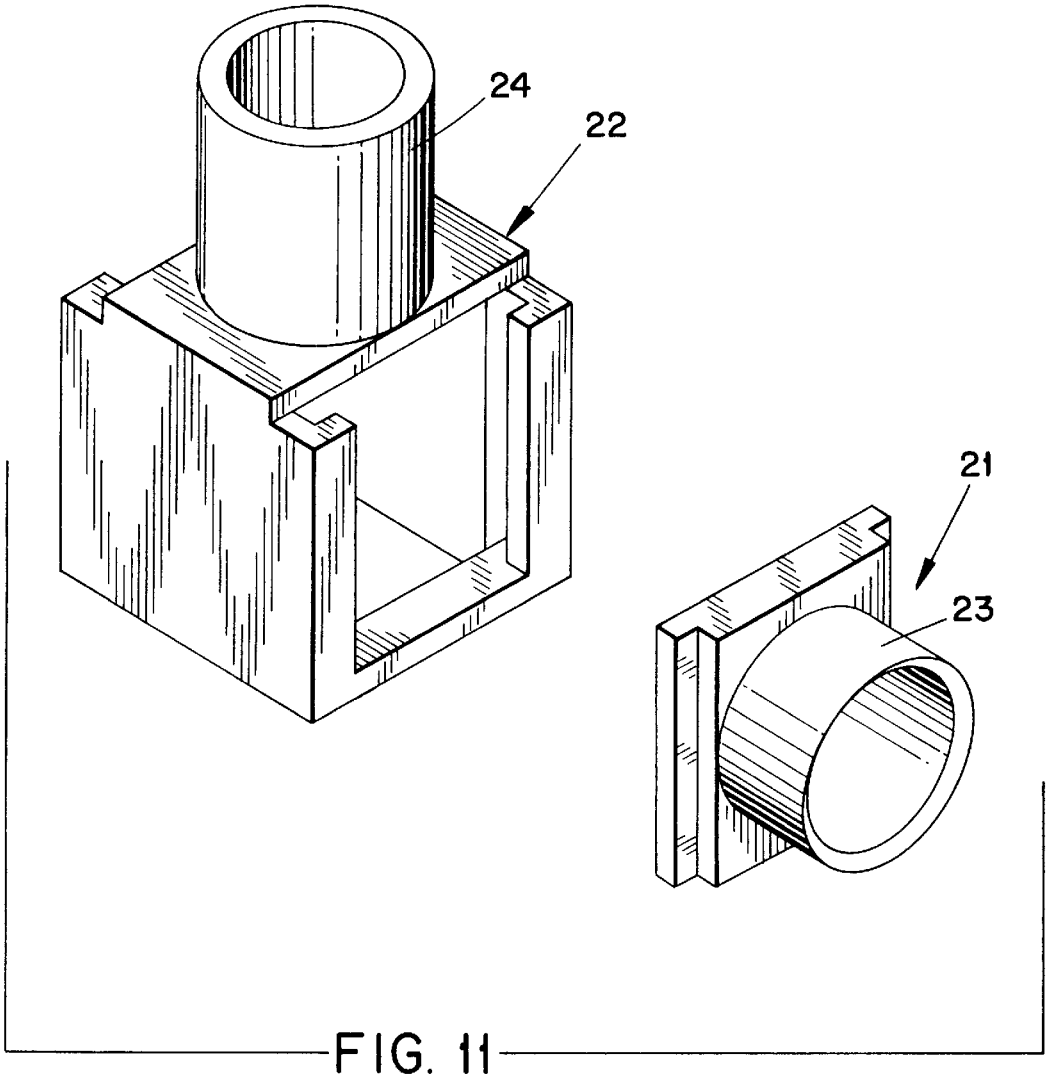
FIG. 11 is an exploded perspective view of another embodiment of the cutter element assembly of the invention.

The cutting elements in the embodiment shown in FIGS. 1–10 have a scalloped cutting edge. The embodiment shown in FIG. 11 comprises carrier module 22 having handle coupling section 24 and cutting element 21 having a continuous cutting edge 23 as shown. Clearly the carrier module of the invention may have only one set of slots rather than the two sets of slots disclosed for holding two cutting elements. It is also conceivable that additional slotted configurations may be made through additional modifications on the two remaining sides of the carrier module if so desired. Moreover, other mounting configurations for removably securing the carrier elements to carrier module 12 are deemed mechanically possible.

While the hole forming assembly for irrigation tubing has been, shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A hand tool combination for punching various sized holes in the sidewall of irrigation tubing to discharge water onto crop-growing soil, said tool combination comprising:

a) an elongated handle member including a hand grasping section at one end thereof and carrying a cutter element assembly at the other end thereof, b) said cutter element assembly including a cutting element carrier module having means for removably mounting at least one hole-forming cutting element at a location thereon, and c) a set of a plurality of interchangeable cutting elements each having a structural configuration effective to be interchangeably mounted at said location on said cutting element carrier module and each including cutting edge means effective to penetrate the sidewall of said irrigation tubing when thrust against said tubing by an individual gripping said hand grasping section and swinging said cutter element assembly toward said sidewall.

2. A combination as defined in claim 1 wherein each cutting element includes a base portion and cutting edge support means projecting outwardly from one side of said base portion to provide said cutting edge means at a laterally spaced distance from the base portion to effect said penetration of said sidewall of the irrigation tubing, and said cutting element carrier module includes means for removably receiving said base portion of the cutting element to direct the cutting edge support means outwardly from said cutter element assembly.

3. A combination as defined in claim 1 wherein each of the cutting elements includes base means having shoulder means disposed on opposing sides thereof, and said carrier module includes slot means to slidingly receive said shoulder means and secure the base means in a fixed operating position within said carrier module.

4. A combination as defined in claim 3 wherein each of the cutting elements includes abutment means for tightening the disposition of each cutting element within said slot means.

5. A combination as defined in claim 1 wherein the cutting edge means of each said cutting element produces different sized openings upon penetration of said sidewall.

6. A combination as defined in claim 5 wherein each said cutting element includes a base portion and cutting edge support means projecting outwardly from one side of said base portion to provide said cutting edge means at a laterally spaced distance from the base portion to effect said penetration of said sidewall of the irrigation tubing, each said cutting edge support means comprises an annular wall portion having an outer end section that includes said cutting edge means.

7. A combination as defined in claim 6 wherein the outer end section of each said annular wall portion has a scalloped outer edge that forms said cutting edge means.

8. A combination as defined in claim 6 wherein the outer end section of each said annular wall portion has a straight outer edge that forms said cutting edge means.

9. A combination as defined in claim 6 wherein said annular wall portion is cylindrical and said cutting edge means produces circular openings in said sidewall of the irrigation tubing.

10. A combination as defined in claim 9 wherein each of the cutting edge means for the different cutting elements forms openings in said sidewall that differ by at least 1/16 of an inch in diameter.

11. A combination as defined in claim 6 wherein each annular wall portion includes tapered inner and outer surfaces effective to enable the nesting together of said plurality of cutting elements.

12. A combination as defined in claim 11 wherein said set of cutting elements includes ten cutting elements each having a different diameter cylindrical wall portion with its cutting edge means that produces a circular opening in said sidewall of the irrigation tubing, the smallest of the ten cutting elements is effective to form a 7/16 inch diameter circular opening and the largest of the ten cutting elements is effective to form a one inch diameter circular opening.

13. A cutter element assembly for use with an elongated tool handle for punching various sized holes in the sidewall of irrigation tubing to discharge water onto crop-growing soil, said assembly comprising:

a) means for mounting the assembly to one end of an elongated handle member and said assembly including a cutting element carrier module having means for removably mounting at least one hole-forming cutting element at a location thereon module, and b) a set of a plurality of interchangeable cutting elements each having a structural configuration effective to be interchangeably mounted at said location on said cutting element carrier module and each including cutting edge means effective to penetrate the sidewall of said irrigation tubing when the cutter element assembly is mounted to said elongated handle member and is thrust against said tubing by an individual gripping said handle member and swinging said cutter element assembly toward said sidewall.

14. An assembly as defined in claim 13 wherein each cutting element includes a base portion and cutting edge support means projecting outwardly from one side of said base portion to provide said cutting edge means at a laterally spaced distance from the base portion to effect said penetration of said sidewall of the irrigation tubing, and said cutting element carrier module includes means for removably receiving said base portion of the cutting element to direct the cutting edge support means outwardly from said cutter element assembly.

15. An assembly as defined in claim 13 wherein each of the cutting elements includes base means having shoulder means disposed on opposing sides thereof, and said carrier module includes slot means to slidingly receive said shoulder means and secure the base means in a fixed operating position within said carrier module.

16. An assembly as defined in claim 15 wherein each of the cutting elements includes abutment means for tightening the disposition of each cutting element within said slot means.

17. An assembly as defined in claim 13 wherein each said cutting element includes cutting edge means that produces different sized openings upon penetration of said sidewall.

18. An assembly as defined in claim 17 wherein each said cutting element includes a base portion and cutting edge support means projecting outwardly from one side of said base portion to provide said cutting edge means at a laterally spaced distance from the base portion to effect said penetration of said sidewall of the irrigation tubing, each said cutting edge support means comprises an annular wall portion having an outer end section that includes said cutting edge means.

19. An assembly as defined in claim 18 wherein said annular wall portion is cylindrical and said cutting edge means produces circular openings in said sidewall of the irrigation tubing.

20. An assembly as defined in claim 18 wherein each annular wall portion includes tapered inner and outer surfaces effective to enable the nesting of said plurality of cutting elements.

* * * * *